US009534532B2

(12) United States Patent
Eybergen et al.

(10) Patent No.: US 9,534,532 B2
(45) Date of Patent: Jan. 3, 2017

(54) SUPERCHARGER ASSEMBLY WITH TWO ROTOR SETS

(71) Applicant: EATON CORPORATION, Cleveland, OH (US)

(72) Inventors: William Nicholas Eybergen, Macomb County, MI (US); Robert Philip Benjey, Dexter, MI (US)

(73) Assignee: Eaton Corporation, Cleveland, OH (US)

( * ) Notice: Subject to any disclaimer, the term of this patent is extended or adjusted under 35 U.S.C. 154(b) by 299 days.

(21) Appl. No.: 14/348,380

(22) PCT Filed: Sep. 28, 2012

(86) PCT No.: PCT/US2012/057709
§ 371 (c)(1),
(2) Date: Mar. 28, 2014

(87) PCT Pub. No.: WO2013/049439
PCT Pub. Date: Apr. 4, 2013

(65) Prior Publication Data

US 2014/0283797 A1 Sep. 25, 2014

Related U.S. Application Data

(60) Provisional application No. 61/541,601, filed on Sep. 30, 2011, provisional application No. 61/683,931, filed on Aug. 16, 2012.

(51) Int. Cl.
*F02B 33/00* (2006.01)
*F02B 33/44* (2006.01)
(Continued)

(52) U.S. Cl.
CPC ..... *F02B 33/40* (2013.01); *F02B 33/38* (2013.01); *F02B 39/04* (2013.01); *F02B 39/06* (2013.01);
(Continued)

(58) Field of Classification Search
CPC ..... F02B 33/40; F02B 33/38; F02B 39/04; F02B 39/06; F02B 39/10; F02B 39/12; F02N 11/003; F02N 11/04; F02N 15/046; F02N 15/022
(Continued)

(56) References Cited

U.S. PATENT DOCUMENTS 1,752,224 A 3/1930 Apple
2,358,815 A * 9/1944 Lysholm ..... F02C 3/055 418/9
(Continued)

FOREIGN PATENT DOCUMENTS

CN 1982670 A 6/2007
CN 101326068 A 12/2008
(Continued)

OTHER PUBLICATIONS

International Search Report for corresponding International Patent Application PCT/US2012/057709 mailed Mar. 26, 2013.
(Continued)

*Primary Examiner* — Thai Ba Trieu
(74) *Attorney, Agent, or Firm* — Merchant & Gould P.C.

(57) ABSTRACT

A supercharger (12) with two separate sets of rotors (22, 24) arranged in parallel with one another is provided in an engine assembly. Both sets of rotors are used to boost air flow during high engine air flow conditions, and only one of the sets of rotors is operable to transfer torque generated by the throttling loss pressure drop as stored energy in a load device during low air flow conditions. The captured throt-
(Continued)

tling losses may be electrical energy stored in a battery via a motor/generator such as during vehicle cruising.

20 Claims, 6 Drawing Sheets

(51) Int. Cl.

| | |
|---|---|
| ***F04C 11/00*** | (2006.01) |
| ***F04C 13/00*** | (2006.01) |
| ***F04C 23/00*** | (2006.01) |
| ***F02B 33/40*** | (2006.01) |
| ***F02B 33/38*** | (2006.01) |
| ***F02N 11/00*** | (2006.01) |
| ***F02B 39/04*** | (2006.01) |
| ***F02B 39/06*** | (2006.01) |
| ***F02B 39/10*** | (2006.01) |
| ***F02B 39/12*** | (2006.01) |
| ***F02N 15/04*** | (2006.01) |
| *F02N 11/04* | (2006.01) |
| *F02N 15/02* | (2006.01) |

(52) U.S. Cl.
CPC ..... *F02B 39/10* (2013.01); *F02B 39/12* (2013.01); *F02N 11/003* (2013.01); *F02N 15/046* (2013.01); *F02N 11/04* (2013.01); *F02N 15/022* (2013.01)

(58) Field of Classification Search
USPC ..... 123/559.1–559.3, 562; 60/611; 418/201.1, 9
See application file for complete search history.

(56) References Cited

U.S. PATENT DOCUMENTS

| | | | | | |
|---|---|---|---|---|---|
| 2,390,487 | A | | 12/1945 | Lawrence et al. | |
| 2,400,306 | A | | 5/1946 | Hobbs | |
| 2,441,779 | A | | 5/1948 | Troeger et al. | |
| 2,965,083 | A | | 12/1960 | Percival | |
| 2,975,963 | A | * | 3/1961 | Hans | F04C 18/16 418/9 |
| 3,184,155 | A | * | 5/1965 | Crooks | F04C 18/16 418/9 |
| 3,676,999 | A | | 7/1972 | Oldfield | |
| 3,741,676 | A | * | 6/1973 | Silvern | F04D 25/163 415/11 |
| 3,804,565 | A | * | 4/1974 | Sennet | F04C 2/165 418/201.1 |
| 3,958,419 | A | * | 5/1976 | Laing | F02B 67/08 60/397 |
| 3,976,390 | A | * | 8/1976 | Silvern | F04D 27/0215 415/11 |
| 4,068,984 | A | * | 1/1978 | Spindler | F04C 18/16 418/201.1 |
| 4,083,188 | A | | 4/1978 | Kumm | |
| 4,478,043 | A | | 10/1984 | Kobavashi et al. | |
| 4,729,225 | A | | 3/1988 | Bucher | |
| 4,825,839 | A | | 5/1989 | Mehnert | |
| 5,121,607 | A | | 6/1992 | George, Jr. | |
| 5,125,806 | A | | 6/1992 | Quick et al. | |
| 5,158,427 | A | | 10/1992 | Shirai | |
| 5,195,881 | A | | 3/1993 | George, Jr. | |
| 5,241,817 | A | | 9/1993 | George, Jr. | |
| 5,263,832 | A | * | 11/1993 | Yamaguchi | F04C 29/04 418/9 |
| 5,713,204 | A | | 2/1998 | Kadlicko | |
| 5,890,468 | A | | 4/1999 | Ozawa | |
| 8,087,401 | B2 | | 1/2012 | Inoue | |
| 8,151,773 | B2 | | 4/2012 | Prior | |
| 8,196,686 | B2 | | 6/2012 | Grieve | |
| 2004/0237949 | A1 | | 12/2004 | Yasui | |
| 2007/0051349 | A1 | | 3/2007 | Marumoto et al. | |
| 2007/0137626 | A1 | | 6/2007 | Turner | |
| 2008/0087482 | A1 | | 4/2008 | Ledger et al. | |
| 2008/0173017 | A1 | | 7/2008 | St. James | |
| 2008/0289610 | A1 | | 11/2008 | Nguyen-Schaefer et al. | |
| 2008/0312803 | A1 | | 12/2008 | Igarashi et al. | |
| 2009/0048745 | A1 | | 2/2009 | Wu et al. | |
| 2009/0222188 | A1 | | 9/2009 | Igarashi | |
| 2009/0277215 | A1 | * | 11/2009 | Tsuboi | F04C 18/16 418/5 |
| 2009/0288648 | A1 | * | 11/2009 | Prior | F04C 18/16 123/559.1 |
| 2009/0291803 | A1 | | 11/2009 | Moeller | |
| 2010/0071673 | A1 | | 3/2010 | Prior | |
| 2010/0155157 | A1 | | 6/2010 | Grieve | |
| 2011/0067395 | A1 | | 3/2011 | Suhocki | |
| 2011/0094480 | A1 | | 4/2011 | Suhocki et al. | |
| 2012/0041664 | A1 | | 2/2012 | Hansen et al. | |
| 2013/0089413 | A1 | * | 4/2013 | Fujimoto | F04C 29/04 415/177 |
| 2013/0090832 | A1 | | 4/2013 | Bevan et al. | |
| 2013/0146035 | A1 | | 6/2013 | Eybergen et al. | |
| 2014/0208745 | A1 | | 7/2014 | Suhocki et al. | |
| 2014/0224228 | A1 | | 8/2014 | Benjey et al. | |
| 2014/0238361 | A1 | | 8/2014 | Tsourapas et al. | |
| 2015/0260187 | A1 | * | 9/2015 | Endo | F04C 18/16 418/84 |

FOREIGN PATENT DOCUMENTS

| | | | | | |
|---|---|---|---|---|---|
| CN | 201159098 | Y | | 12/2008 | |
| CN | 102072011 | A | | 5/2011 | |
| CN | 2002944330 | U | | 5/2013 | |
| DE | 3801227 | A1 | * | 11/1988 | F02B 39/04 |
| DE | 39 33 409 | A1 | | 4/1991 | |
| DE | 11 2005 000486 | T5 | | 1/2007 | |
| EP | 0222989 | A1 | * | 5/1987 | F02B 33/36 |
| EP | 1 462 629 | A1 | | 9/2004 | |
| EP | 1 895 130 | A1 | | 9/2004 | |
| GB | 2 456 600 | A | | 7/2009 | |
| JP | 60-075722 | A | | 4/1985 | |
| JP | 61004889 | A | * | 1/1986 | F04C 18/16 |
| JP | 61-159689 | U | | 10/1986 | |
| JP | 62-101830 | A | | 5/1987 | |
| JP | 2-24042 | U | | 2/1990 | |
| JP | 03225028 | A | * | 10/1991 | |
| JP | 5-263649 | A | | 10/1993 | |
| JP | 7-097939 | A | | 4/1995 | |
| JP | 2001-073784 | A | | 3/2001 | |
| JP | 2003-161156 | A | | 6/2003 | |
| JP | 2005-042553 | A | | 2/2005 | |
| JP | 2005-054612 | A | | 3/2005 | |
| JP | 2005-188318 | A | | 7/2005 | |
| JP | 2005-291020 | A | | 10/2005 | |
| JP | 2006-083767 | A | | 3/2006 | |
| JP | 2006-233803 | A | | 9/2006 | |
| JP | 2006-258094 | A | | 9/2006 | |
| JP | 2006-307648 | A | | 11/2006 | |
| JP | 2007-016721 | A | | 1/2007 | |
| JP | 2007-104855 | A | | 4/2007 | |
| JP | 2007-192092 | A | | 8/2007 | |
| JP | 2008-063974 | A | | 3/2008 | |
| JP | 2008-215074 | A | | 9/2008 | |
| JP | 2008-215075 | A | | 9/2008 | |
| JP | 2009-243268 | A | | 10/2009 | |
| JP | 2010-065656 | A | | 3/2010 | |
| KR | 2005-0039187 | A | | 4/2005 | |
| KR | 1020070005461 | A | * | 1/2007 | F04C 18/16 |
| WO | 2008/020184 | A1 | | 2/2008 | |
| WO | 2009/136994 | A1 | | 11/2009 | |
| WO | 2013/049435 | A1 | | 4/2013 | |
| WO | 2013/049438 | A2 | | 4/2013 | |

OTHER PUBLICATIONS

International Search Report for corresponding International Patent Application No. PCT/US 2012/057702 mailed Dec. 3, 2012.

(56) References Cited

OTHER PUBLICATIONS

International Search Report for corresponding International Patent Application No. PCT/US2012/057706 mailed Mar. 26, 2013.

* cited by examiner

SUPERCHARGER ASSEMBLY WITH TWO ROTOR SETS

RELATED APPLICATIONS

This application is a National Stage Application of PCT/US2012/057709, filed 28 Sep. 2012, which claims benefit of U.S. Patent Application Ser. No. 61/541,601 filed on 30 Sep. 2011 and U.S. Patent Application Ser. No. 61/683,931 filed on 16 Aug. 2012 and which applications are incorporated herein by reference. To the extent appropriate, a claim of priority is made to each of the above disclosed applications.

TECHNICAL FIELD

The present teachings generally include a supercharger with two sets of rotors placed in series with an engine throttle.

BACKGROUND

Energy efficient engines of reduced size are desirable for fuel economy and cost reduction. Smaller engines provide less torque than larger engines. A supercharger is sometimes used to increase the torque available from an engine. At low engine speeds, when higher torque is often requested by a vehicle operator by depressing the accelerator pedal, the supercharger provides additional air to the engine intake manifold, boosting air pressure and thereby allowing the engine to generate greater torque at lower engine speeds.

SUMMARY

The present teachings generally include an assembly for controlling air flow to an engine. The engine has cylinders and an engine throttle in a throttle body positioned in the air flow to the cylinders. The assembly includes a supercharger having a first and a second set of rotors arranged in the air flow in series with the engine throttle, and in parallel with one another. A gear arrangement is operatively connectable to the supercharger. A load device such as an electric motor/generator is operatively connectable to the supercharger by the gear arrangement. Controllable valves include a first valve operable to control air flow between an air inlet and an air outlet of the first set of rotors and a second valve operable to control air flow from the outlet of the first set of rotors to the throttle. The first valve, the second valve and the throttle are selectively positionable to allow both sets of rotors to supply boost pressure to the engine cylinders under a first predetermined engine operating condition and to allow only the second set of rotors to apply torque through the gear train to the load device under a second predetermined engine operating condition to thereby recapture throttling losses. Recapture of throttling losses is also referred to herein as regeneration or recovery of throttling losses. Throttling losses or throttle losses are the unused energy associated with the pressure drop that occurs across the throttle due to the vacuum created by reciprocating pistons in the engine cylinders, and because of the inefficiency created by the turbulence in air flow around the throttle at low throttle (i.e., only partially opened throttle) conditions. By controlling the valves, the throttling losses can instead be placed across the second set of rotors, creating a torque on the second set of rotors, which is converted to energy by the variable load device, such as stored electrical energy.

Accordingly, both sets of rotors can be used to provide sufficient air flow boost during high engine air flow conditions, and only the second set of rotors is operable to enable capture of throttling losses as stored energy during low air flow demand, such as during vehicle cruising.

The above features and advantages and other features and advantages of the present teachings are readily apparent from the following detailed description of the best modes for carrying out the present teachings when taken in connection with the accompanying drawings.

DETAILED DESCRIPTION

Figure 1:
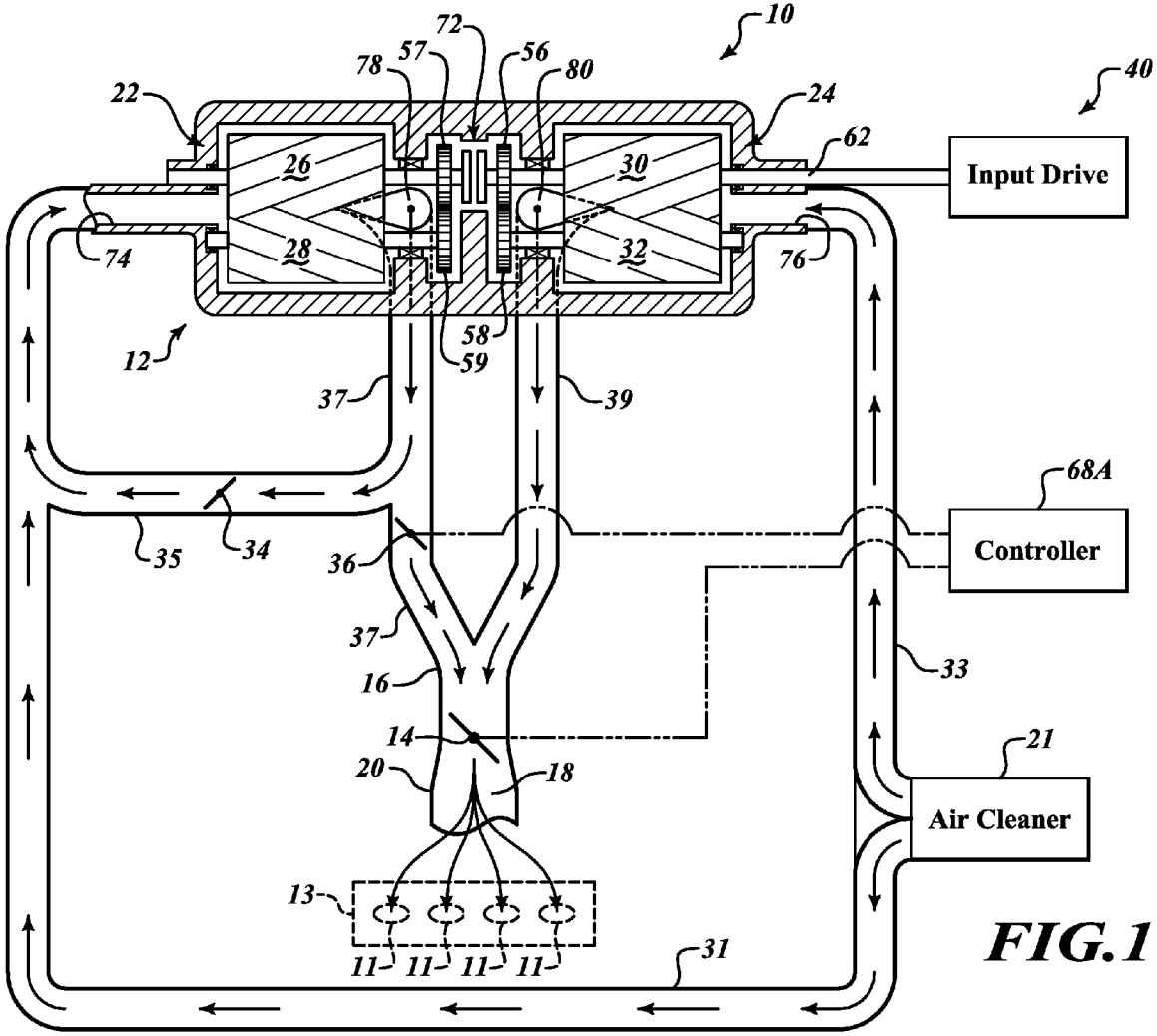
FIG. 1 is a schematic illustration in partial cross-sectional view of an engine assembly with a supercharger having two sets of rotors and valves.

Referring to the drawings, wherein like reference numbers refer to like components throughout the several views, FIG. 1 shows an engine assembly 10 that includes a supercharger 12 placed in series with a throttle 14 in a throttle body 16 in the air flow upstream of a plenum 18 in an engine air intake manifold 20 through which air is introduced into engine cylinders 11 of an engine 13. The throttle 14 is also referred to herein as a throttle valve. The supercharger 12 can have two separate sets of rotors 22, 24, each having a first rotor 26, 30 that meshes with a respective second rotor 28, 32. Each rotor 26, 28, 30, 32 can have multiple lobes. The sets of rotors 22, 24 can be arranged in parallel with one another in air flow to the engine cylinders 11, and in series with the throttle 14. Movement of pistons in the engine cylinders 11 creates a vacuum that pulls the air through the plenum 18. The throttle 14 is downstream in the air flow from the supercharger 12 and controls air flow from the throttle body 16 to the engine cylinders 11. As used herein, a first component is "downstream" in air flow from a second component if the direction of air flow requires that the air flows past the second component prior to the first component when air is directed past both components. Similarly, a first component is "upstream" in air flow from a second component if the direction of air flow requires that the air flows past the first component prior to the second component when air is directed past both components. The throttle 14 is shown downstream of the supercharger 12. It should be understood that the functionality of the supercharger 12 described herein can also be achieved if the supercharger 12 was positioned downstream of the throttle 14. In either configuration, the throttle 14 and the supercharger 12 are considered to be in series with one another in the air flow to the engine cylinders 11. Two components are "in series" with one another in the air flow to the engine 13 when air that flows past one of the components subsequently flows past the other component. As used herein, the first set of rotors 22 is in parallel with the second set of rotors 24 because air can flow to the plenum 18 through the first set of rotors 22 or through the second set of rotors 24 without first passing through the other set of rotors as would be necessary if the sets of rotors 22, 24 were arranged in series with one another.

The supercharger 12 can boost the air pressure upstream of the air plenum 18, forcing more air into engine cylinders 11, and thus can be shown to increase engine power. As further discussed herein, because there are two separate sets of rotors 22, 24, as well as a selectively controllable first valve 34 and second valve 36, sufficient engine boost can be provided for a first predetermined engine operating condition such as acceleration at relatively low engine speeds, which is a high power demand operating condition, while highly efficient capture of throttling losses can occur during a second predetermined engine operating condition, such as engine cruising (i.e., operation at a relatively constant engine speed which is a low power demand operating condition). The valves 34, 36 are also referred to herein as bypass valves.

The throttle 14 and the valves 34, 36 are shown as butterfly valves that are each pivotable about a respective pivot axis through the center of the valve 14, 34, or 36 between a closed position and an open position. In the closed position, the valve 34 or 36 is generally perpendicular to the walls of the respective surrounding air passage 35, 37. When the throttle 14 is in a closed position, it is generally perpendicular to the walls of the surrounding throttle body 16. In the open position, the valve 34 or 36 is generally parallel to the walls of the respective surrounding passage 35, 37 or, in the case of the throttle 14, the surrounding throttle body 16. The valves 14, 34, 36 may also be moved to a variety of intermediate positions between the closed position and the open position. In FIG. 1, the valves 14, 34, 36 are each shown in an intermediate position. A controller 68A controls the operation of the valves 14, 34, 36. The controller 68A can be an engine controller.

The supercharger 12 can be a fixed displacement supercharger, such as a Roots-type supercharger, with each respective set of rotors 22, 24 outputting a fixed volume of air per rotation. The increased air output from the supercharger 12 then becomes pressurized when forced into the air plenum 18. A Roots-type supercharger is a volumetric device, and therefore is not dependent on rotational speed in order to develop pressure. The volume of air delivered by the Roots-type supercharger per each rotation of the supercharger rotors is constant (i.e., does not vary with speed). A Roots-type supercharger can thus develop pressure at low engine speeds because the Roots-type supercharger functions as a pump rather than as a compressor. Compression of the air delivered by the Roots-type supercharger takes place downstream of the supercharger in the engine plenum 18. Alternatively, the supercharger 12 can be a compressor, such as a centrifugal-type supercharger that is dependent on rotational speed in order to develop pressure. A centrifugal-type supercharger compresses the air as it passes through the supercharger but must run at higher speeds than a Roots-type supercharger in order to develop a predetermined pressure. Still further, one of the sets of rotors 22 or 24 can be a Roots-type supercharger and the other of the sets of rotors 22 or 24 can be a centrifugal-type supercharger.

Figure 2:
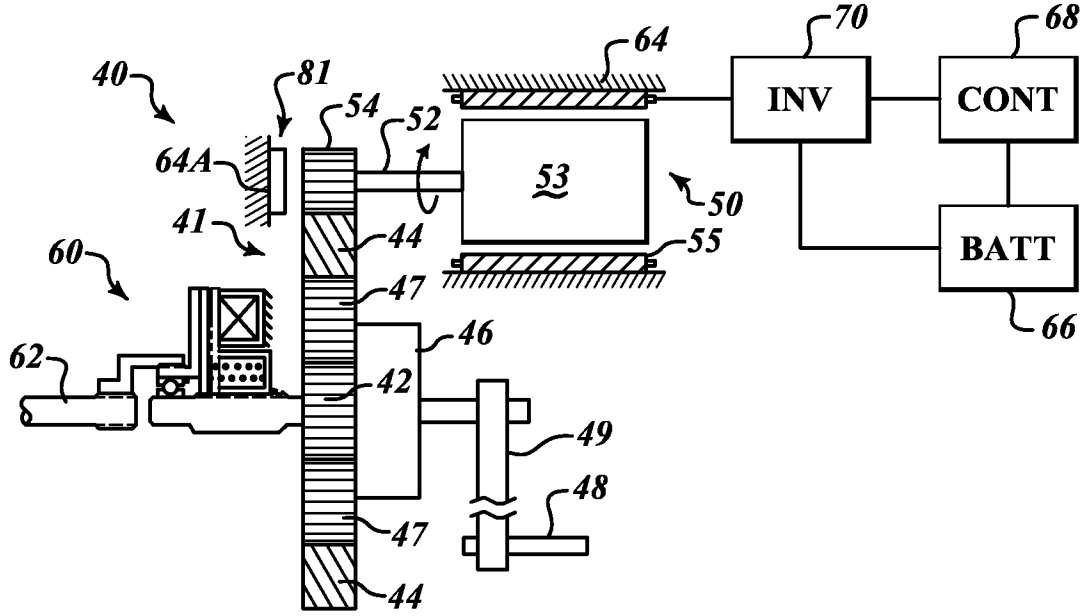
FIG. 2 is a schematic illustration in partial cross-sectional view of an input drive of the engine assembly of FIG. 1.

The engine assembly 10 of FIG. 1 includes an input drive 40 shown in greater detail in FIG. 2. The input drive 40 has a gear arrangement 41 that can enable a variable speed drive. The gear arrangement can be a planetary gear set 41 with a sun gear member 42, a ring gear member 44, and a carrier member 46 that can rotatably support a set of pinion gears 47 that can mesh with both the ring gear member 44 and the sun gear member 42. An engine crankshaft 48 can rotate with the carrier member 46 through a belt drive 49. An electric motor/generator 50 has a rotatable motor shaft 52 with a rotatable gear 54 mounted on the motor shaft 52. The motor/generator 50 is a load device as it can create a load when acting as a generator to transfer torque to electric energy and can apply a torque load when acting as a motor. The load is a variable load because the speed of the motor/generator 50 can be controlled. The motor shaft 52 is driven by a motor rotor 53. A stator 55 is mounted to a stationary member 64, such as a motor casing. The rotatable gear 54 can mesh with the ring gear member 44. The sun gear member 42 can connect for rotation with the first rotors 26, 30 of the supercharger 12 through a two-position clutch 60 as explained herein. The first rotors 26, 30 can cause rotation of the second rotors 28, 32 via a set of meshing gears 56, 58 shown in FIG. 1. In aspects of the present teachings that have an optional clutch 72 (discussed hereinafter), an additional set of meshing gears 57, 59 can control the rotational speed of the second rotor 28 with respect to the first rotor 26 when the clutch 72 is engaged.

Figure 4:
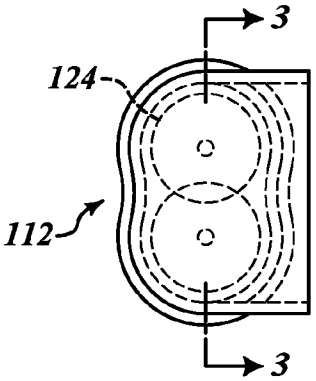
FIG. 4 is a schematic illustration in side view of a portion of the supercharger of FIG. 3, showing the sets of rotors with hidden lines.
Figure 3:
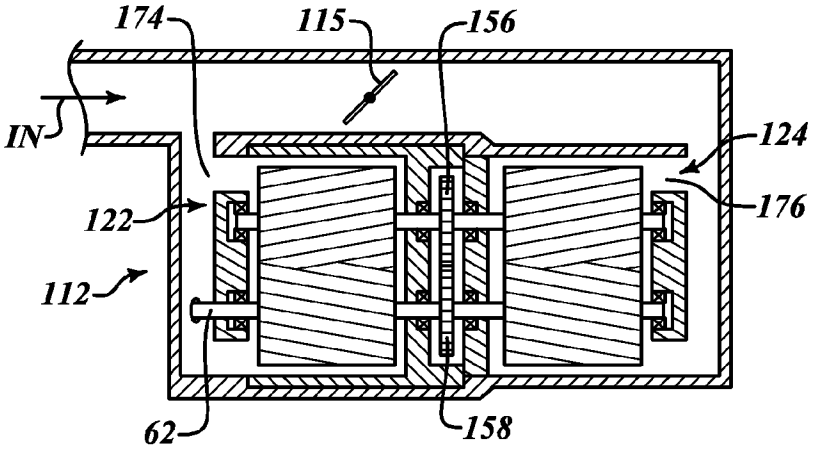
FIG. 3 is a schematic illustration in partial cross-sectional view taken at lines 3-3 in FIG. 4 of a supercharger for use with the engine assembly of FIG. 1 in accordance with an alternative aspect of the present teachings.
Figure 5:
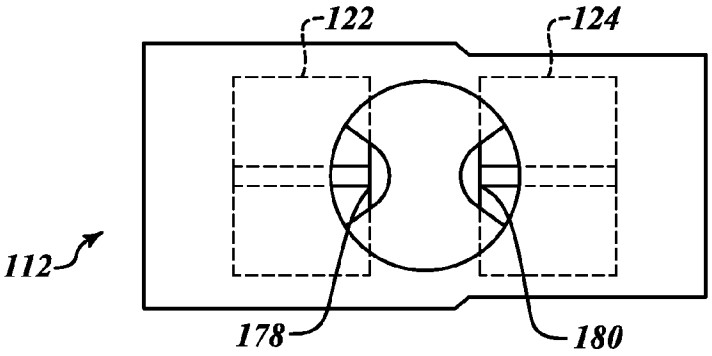
FIG. 5 is a schematic illustration in plan view of the supercharger of FIGS. 3 and 4, showing the air outlets of the supercharger, and showing the sets of rotors with hidden lines.

FIG. 3 shows an aspect of the present teachings including a supercharger 112 like the supercharger 12 except without a clutch 72 and without the meshing set of gears 57, 59. The supercharger 112 can be used in the assembly 10 in place of supercharger 12. The supercharger 112 has a first set of rotors 122, a second set of rotors 124, and one set of meshing gears 156, 158. FIG. 3 shows a bypass valve 115 that allows air to bypass the inlets 174, 176 of both sets of rotors 122, 124 and proceed to the outlets 178, 180 shown in FIG. 5. Although not visible in the cross-section of FIG. 3, additional air passages and valves configured like valves 34 and 36 enable the supercharger 112 to provide the same functionality as the supercharger 12 of FIG. 1. FIG. 4 shows the supercharger 112 in side view, with the set of rotors 124 indicated with hidden lines. FIG. 5 shows the supercharger 112 in plan view, indicating the air outlets 178, 180 of the sets of rotors 122, 124, and with the sets of rotors 122, 124 shown with hidden lines.

Figure 8:
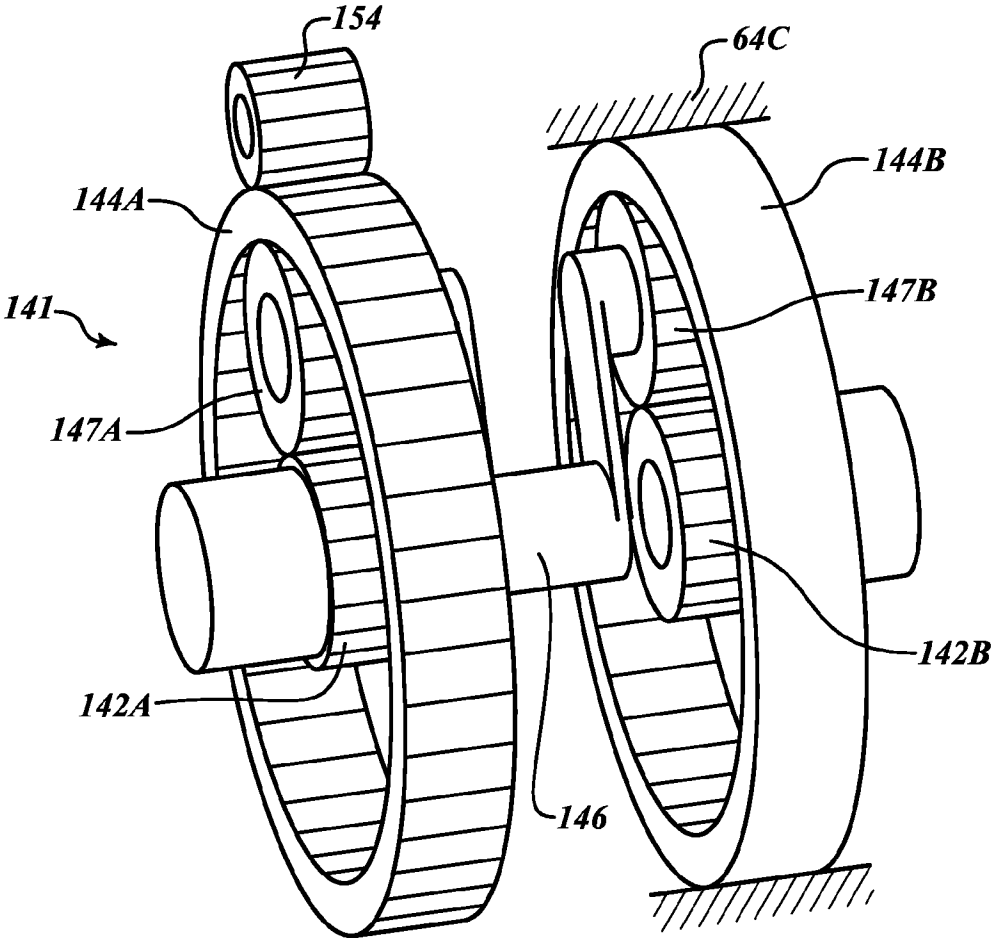
FIG. 8 is a schematic perspective illustration of a gear arrangement for the input drive of FIG. 2 in accordance with an alternative aspect of the present teachings.

In certain aspects of the present teachings, the input drive 40 is not limited to the arrangement shown in FIG. 2. In further aspects, instead of the gear arrangement 41 of FIG. 2, the gear arrangement can be a planetary gear set 141 as shown in FIG. 8. The planetary gear set 141 is a compounded, dual-planetary gear set having two ring gear members 144A, 144B, two sun gear members 142A, 142B, and a common carrier member 146 that supports a first set of pinion gears 147A that mesh with one of the ring gear members 144A and one of the sun gear members 142B, and a second set of pinion gears 147B that mesh with the other ring gear member 144B and the other sun gear member 142B. Although each set of pinion gears 147A, 147B includes multiple pinion gears, only one pinion gear of each set of pinion gears 147A, 147B is shown for clarity in the drawing. The engine crankshaft 48 of FIG. 2 can be operatively connected with the input sun gear member 142A. A motor/generator like that of FIG. 3 has a motor shaft that rotates with a rotatable gear 154 that can mesh with the ring gear member 144A. The rotatable gear 154 is clutched like gear 54 of FIG. 2. The ring gear member 144B is can be grounded to a stationary member 64C. The sun gear member 142B can be connectable for rotation with the first rotor 26, 30 of each set of rotors 22, 24 of the supercharger 12 of FIG. 1.

The input drive 40 of FIG. 2 can be selectively connectable for driving the first and second sets of rotors 22, 24 via a two-position clutch 60 that selectively connects the sun gear member 42 with a shaft 62. The rotor 30 of the first set of rotors 24 is mounted on the shaft 62 and rotates with the shaft 62. The two-position clutch 60 can be controllable by an electronic controller 68 and an actuator 94, as shown and described with respect to FIG. 7, to move between two alternate positions. In a first position, the clutch 60 can ground the sun gear member 42 of FIG. 2 to a stationary member 64A (i.e., a non-rotating member) such as a housing of the input drive 40. In an embodiment with the compound planetary gear set 141, the clutch 60 can ground the sun gear member 142B to the stationary member 64C. A battery 66 can be used to provide electric power to the motor/generator 50 when the motor/generator 50 is controlled to function as a motor, and to receive electrical power from the motor/generator 50 when the motor/generator 50 is controlled to function as a generator. Vehicle electrical devices can also draw electric power from the battery 66. A controller 68 can control the functioning of the motor/generator 50 as a motor or as a generator. A power inverter 70 can be used to convert the energy supplied by the motor/generator 50 from alternating current to direct current to be stored in the battery 66 when the motor/generator 50 is controlled to operate as a generator, and from direct current to alternating current when the motor/generator 50 is controlled to operate as a motor.

Figure 7:
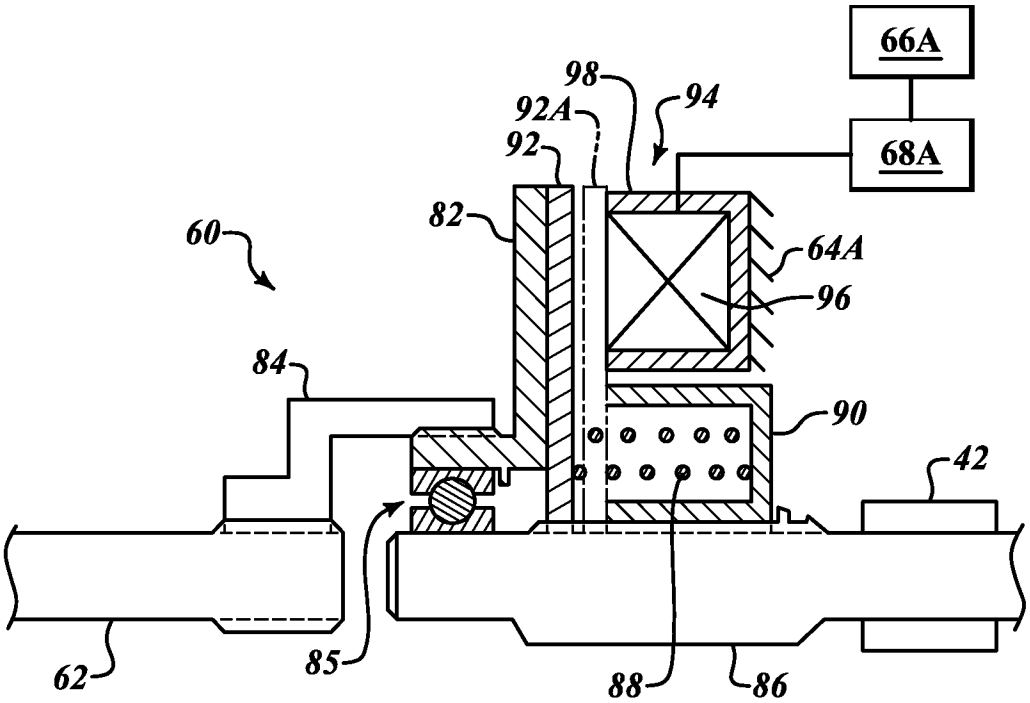
FIG. 7 is a schematic illustration in partial cross-sectional and fragmentary view of one embodiment of a two-position clutch of the input drive of FIG. 2.

When the clutch 60 is in the first position shown in phantom in FIG. 7, the planetary gear set 41 is not operatively connected to the supercharger 12. In a second position shown and described with respect to FIG. 7, the clutch 60 connects the sun gear member 42 for common rotation (i.e., rotation at the same speed) as the first rotors 26, 30 of both sets of rotors 22, 24 of the supercharger 12 (assuming the optional disconnect clutch 72 is engaged in aspects of the present teachings having the clutch 72). The optional disconnect clutch 72 can be operable to disconnect the first set of rotors 22 from the input drive 40 when not engaged, even when the two-position clutch 60 is in the first position. As discussed below, it can be shown that this arrangement allows the engine assembly 10 to run more efficiently in a throttle loss regeneration mode.

When the input drive 40 is operatively connected to one or both sets of rotors 22, 24 via the two-position clutch 60 and the optional disconnect clutch 72, and depending on the controlled positions of the first and the second valves 34, 36 a pressure differential can be created across one or both sets of rotors 22, 24 from air inlets 74, 76 of each sets of rotors 22, 24 to air outlets 78, 80 of each set of rotors 22, 24, upstream of the throttle 14. Air can flow through an air cleaner 21 and through the passages 31, 33 to the air inlets 74, 76, respectively. Air can flow from the air outlets 78, 80 through the passages 37, 39 to the throttle body 16, depending on the positions of the valves 34, 36 and the throttle 14. As described below, the position of the throttle 14, the two-way clutch 60, and the valves 34, 36 can be selectively controlled to provide a desired intake air pressure to the engine cylinders 11 when engine operating demands require relatively high engine torque in a boost operating mode. The positions of the throttle 14, the two-way clutch 60 and the valves 34, 36 can also be controlled to allow the supercharger 12 and the motor/generator 50 to provide regenerative electrical energy to the battery 66 for providing power to vehicle electrical devices in a regenerative operating mode, and/or for providing torque at the crankshaft 48 when the motor/generator 50 is controlled to function as a motor in an engine starting operating mode. Still further, a bypass operating mode can be established when neither boost nor regeneration is desired.

When engine boost is desired, such as may be indicated by an operator depressing an accelerator pedal, an engine boost mode can be established by placing the first valve 34 in a closed position and the second valve 36 in an open position. The first valve 34 will be vertical in FIG. 1 in the closed position and the second valve 36 will be vertical in FIG. 1 in the open position. The two-position clutch 60 of FIGS. 2 and 7 is placed in the second position so that the sun gear member 42 is connected for rotation with the shaft 62 and the engine crankshaft 48 drives the sets of rotors 22, 24. As described with respect to FIG. 7, the second position is achieved when the coil 96 of the actuator of clutch 60 is not energized. If a clutch 72 is provided, it can be engaged.

When the valve 34 is in the closed position, no air flows through passage 35 so that the air inlet 74 to the first set of rotors 22 is not in fluid communication with the air outlet 78 of the first set of rotors 22 except through the supercharger 12, allowing the possibility of a pressure differential to be established by the first set of rotors 22. In other words, when the valve 34 is in a closed position, the air flow represented by arrows through bypass passage 35 cannot occur. Furthermore, closing the valve 34 prevents the air inlet 76 of the second set of rotors 24 from being at the same pressure as the air outlet 80, allowing a pressure differential to be established by the second set of rotors 24.

Because the second valve 36 is in the open position, the air flow from the outlet 78 of the first set of rotors 22 can be provided through passage 37 to the throttle body 16 and plenum 18, and ultimately to the engine cylinders 11. The outlet 80 of the second set of rotors 24 is also in fluid communication with the throttle body 16 and plenum 18. When engine boost is demanded, the throttle 14 can move to a relatively more open position than shown in FIG. 1, such as in response to depression of an accelerator pedal. Both sets of rotors 22, 24 can effectively operate as pumps to increase air flow to the throttle body 16 and plenum 18 to meet operator demand. Accordingly, in the boost mode, both sets of rotors 22, 24 can be operable to increase air boost to the engine cylinders 11.

When operating conditions are such that neither engine boost nor regeneration (i.e., capture) of throttling losses is desired, a bypass operating mode can be established by opening both of the first and the second valves 34, 36. With both valves 34, 36 open, the air inlet 74 of the first set of rotors 22 can be in fluid communication with the air outlet 78 of the first set of rotors 22 through the passage 35, and the air inlet 76 of the second set of rotors 24 is also in fluid communication with the air outlet 80 of the second set of rotors 24 as all of the air passages 31, 33, 35, 37, and 39 are in fluid communication with one another. Accordingly, no pressure differential will be realized across either set of rotors 22, 24. Similarly, neither engine boost nor throttle loss regeneration may be realized.

When operating conditions are such that regeneration of throttling losses is desired, the first valve 34 can be placed in the open position and the second valve 36 can be placed in the closed position. Operating conditions ideal for regeneration can be shown to include when the engine is operating at a steady speed, such as 1500 revolutions per minute, and a state-of-charge of the battery 66 is less than a predetermined maximum state-of-charge threshold, allowing additional electric energy to be stored. With the valve 34 in the open position, no pressure drop may be realized across the first set of rotors 22 because the inlet 74 is in fluid communication with the outlet 78 through the bypass passage 35. If the disconnect clutch 72 is provided, it can be placed in a disengaged state, so that the first set of rotors 22 is not operatively connected with the input drive 40. It can be shown that rotating losses can be avoided that would otherwise be incurred if the first set of rotors 22 was spinning via the input drive 40 but not yet providing boost or regeneration. In aspects of the present teachings without a disconnect clutch 72 and without meshing gears 57, 59, like the supercharger 112 of FIG. 3, the first set of rotors 22 can still be connected with the input drive 40 of FIG. 2 and the first set of rotors 24, but there may not be a pressure differential caused by the first set of rotors due to the positions of the valves 34, 36.

In the throttle loss recovery mode, because the second valve 36 is in the closed position, all of the air to the engine 13 can be passed through the second set of rotors 24. The controller 68 can control the motor/generator 50 to function as a generator. The torque load applied by the motor/generator 50 functioning as a generator can be shown to effectively slow down the speed of the second set of rotors 24, causing the throttle 14 to open and thereby apply a pressure differential across the second set of rotors 24. That is, the vacuum created by the reciprocating pistons in the engine cylinders 11 is moved from the throttle 14 to the second set of rotors 24 when the throttle 14 is opened with the valve 36 closed. The resulting pressure drop from the inlet 76 to the outlet 80 of the second set of rotors 24 creates torque at the rotors 30, 32. The second set of rotors 24 can effectively function as an air motor, extracting torque that is transferred through the planetary gear set 41 and allowing it to be converted to stored electrical energy by the motor/generator 50.

The motor/generator 50 can be controlled so that the rate of electrical energy generated in the throttle loss recovery mode can be balanced against the energy used by the vehicle electrical components, keeping the state-of-charge in the battery 66 relatively constant. The controller 68 can have a processor configured so that the regeneration rate and associated torque drag by the motor/generator 50 is balanced against torque applied by the supercharger 12 to the engine crankshaft 48 to avoid or minimize cyclical charging and dissipating of the battery 66 that might otherwise be necessary during extended vehicle cruising. Various sensors can be used to provide crankshaft 48 torque information and battery 66 state-of-charge data to the controller 68.

In lieu of a motor/generator 50, an alternative variable load device can be operatively connected to the variable speed drive, such as at the ring gear member 44 of the planetary gear set of FIG. 2. For example, an accumulator or a slippable friction clutch can be operatively connected to the ring gear member 44 and controlled to capture throttle loss energy via the supercharger 12. In the case of an accumulator, the energy can be stored as hydraulic or pneumatic pressure. In the case of a slippable friction clutch, the energy can be converted to heat by slipping the clutch, and can then be captured for use in vehicle heating and cooling systems. The load applied by the motor/generator 50, accumulator or slipping clutch can also slow the sun gear member 42 and connected supercharger 12, and can be controlled to manage air flow into the engine cylinders 11, especially at high speeds when there can otherwise be excess air flow to the engine cylinders 11.

Additionally, the motor/generator 50 can be controlled to function as a motor to start the engine 13 by placing the two-position clutch 60 in the first position described with respect to FIG. 7 to ground the sun gear member 42. For example, if the engine 13 is shutoff at a stop light, the motor/generator 50 can be used to restart the engine 13 by rotating the crankshaft 48 through the planetary gear set 41. Thus, fuel savings can be realized during the period that the engine 13 is shutoff, and restarting the engine 13 can be accomplished with the electric energy generated from recaptured throttling losses. The engine 13 can also provide torque via crankshaft 48 to charge the battery 66 through the planetary gear set 41 when the sun gear member 42 is grounded by the clutch 60 and the motor/generator 50 is controlled to function as a generator. The crankshaft 48 can provide torque to run the supercharger 12 through the planetary gear set 41 when a selectively engageable dog clutch 81 is engaged to ground the gear member 54 to the stationary member 64A, thus also holding the ring gear member 44 and the motor/generator 50 stationary. Alternatively, the motor/generator 50 can be held stationary by applying torque to stall the motor/generator 50 through the control of electrical energy to the motor/generator 50. However, the dog clutch 81 can be used to avoid the use of stored electrical energy to hold the motor/generator 50 stationary.

Figure 6:
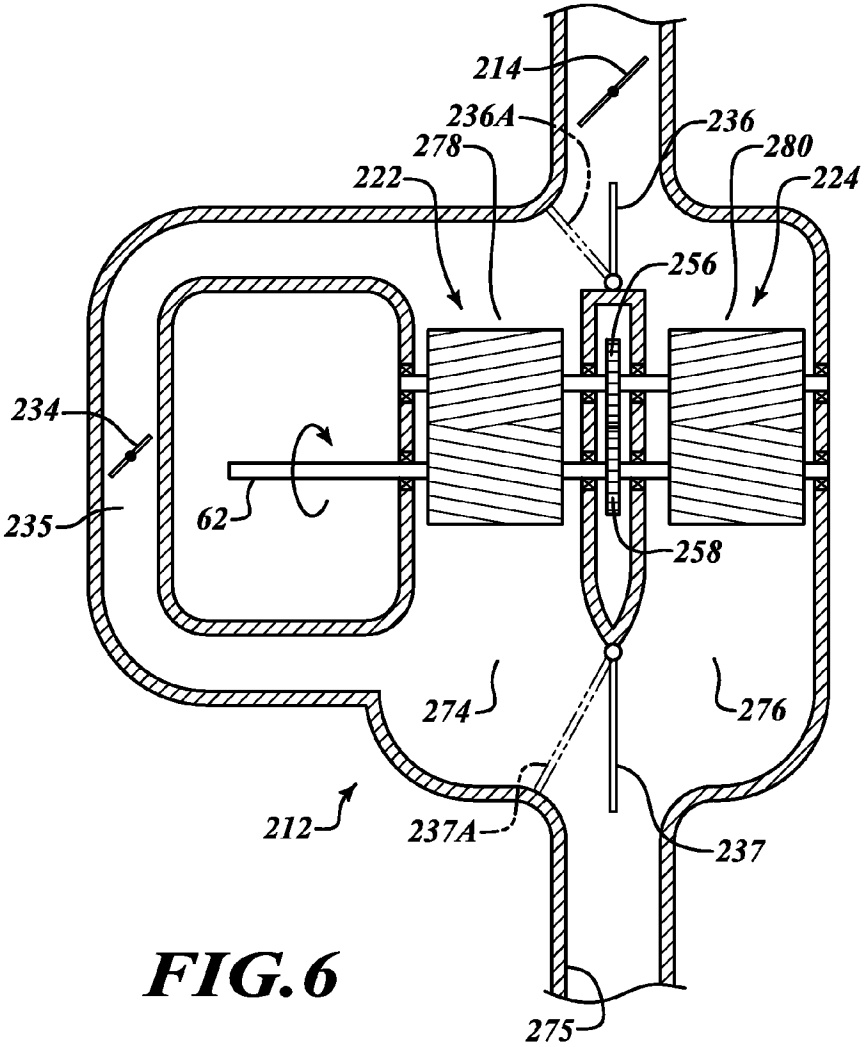
FIG. 6 is a schematic illustration in partial cross-sectional view of a portion of an engine assembly having a supercharger with two sets of rotors in accordance with an alternative aspect of the present teachings.

FIG. 6 shows another aspect of the present teachings including a supercharger 212 with two sets of rotors 222, 224 similar to the superchargers of FIGS. 1, and 3-5. The sets of rotors 222, 224 are in parallel with one another in air flow to engine cylinders 11, and upstream of and in series with a throttle 214. Meshing gears 256, 258 control the relative timing of the rotors of each set of rotors 222, 224. Air passes through an air filter to an inlet 275 and then is split into two separate inlets 274, 276 to the rotors 222, 224 when a valve 237 is in the open position shown. When a valve 236 positioned with respect to an outlet side (downstream in air flow) of outlets 278, 280 of the rotors 222, 224 is in an open position as shown in FIG. 6, and a bypass valve 234 is closed to block air passage 235, air pressure boost is provided by both sets of rotors 222, 224 at the throttle 214. If operating conditions indicate that a throttling loss regeneration mode is desirable, the valves 236, 237 are moved to closed positions 236A, 237A shown in phantom in FIG. 6. The throttle 214 is moved to a fully open position, placing the vacuum caused by the reciprocating pistons in the engine cylinders 11 at the second set of rotors to create a torque on the second set of rotors 224. The motor/generator 50 of FIG. 2 is operatively connected to the sets of rotors 222, 224 by the shaft 62 and is controlled to function as a generator, so that the torque of the rotors 224 is converted to electrical energy stored in the battery 66. A bypass mode is enabled when all of the valves 234, 236, 237 are opened.

FIG. 7 shows the two-position clutch 60 of FIG. 2 in greater detail. The clutch 60 includes a reaction plate 82 splined to an extension 84 that is splined to the shaft 62. The reaction plate 82 is supported on a shaft 86 by a bearing 85. The sun gear member 42 is mounted on or formed with the shaft 86 and rotates with the shaft 86. A spring 88 contained in a spring housing 90 biases a friction plate 92 into engagement with the reaction plate 82. When the friction plate 92 is engaged with the reaction plate 82 as shown in FIG. 7, the clutch 60 is in the second position and the shaft 62 is thereby connected to rotate at the same speed as the sun gear member 42 through the clutch 60. The clutch 60 includes an actuator 94 with a coil 96 held in a coil support 98 mounted to a stationary member 64A, such as a housing for the gear set 41. A battery 66A can be controlled by a controller 68A to selectively energize the coil 96. The battery 66A and controller 68A can be separate from the battery 66 and controller 68 used to control the motor/generator 50. Alternatively, the same battery 66 and controller 68 can be used to control the clutch 60. When the coil 96 is energized, the friction plate 92 is pulled toward the coil 96 by magnetic force to a first position 92A, shown in phantom. The magnetic force of the energized coil 96 overcomes the force of the spring 88, and the spring 88 is compressed by the friction plate 92. In the first position 92A, the friction plate 92 is held to the stationary member 64A, braking the sun gear member 42. The friction plate 92 is not in contact with the reaction plate 82 in the first position, so that shaft 62 is not held stationary by the clutch 60.

The reference numbers used in the drawings and the specification and the corresponding components are as follows:

10 engine assembly
11 engine cylinder
12 supercharger
13 engine
14 throttle valve
16 throttle body
18 plenum
20 manifold
21 air cleaner
22 first set of rotors
24 second set of rotors
26 first rotor of first set
28 second rotor of first set
30 first rotor of second set
31 air passage
32 second rotor of second set
33 air passage
34 first valve
35 air passage
36 second valve
37 air passage
39 air passage
40 input drive
41 gear arrangement
42 sun gear member
44 ring gear member
46 carrier member
47 pinion gears
48 crankshaft
49 belt drive
50 motor/generator
52 motor shaft
53 motor rotor
54 rotatable gear
55 stator
56 meshing gear
57 meshing gear
58 meshing gear
59 meshing gear
60 two-position clutch
62 shaft
64 stationary member
64A stationary member
64C stationary member
66 battery
68 controller
68A controller
68B controller
70 power inverter
72 optional clutch
74 air inlet
76 air inlet
78 air outlet
80 air outlet
81 dog clutch
82 reaction plate
84 extension
85 bearing
86 shaft
88 spring
90 spring housing
92 friction plate
92A first position of friction plate
94 actuator
96 coil
98 coil support
112 supercharger
115 bypass valve
122 first set of rotors
124 second set of rotors
141 compound planetary gear set
142A sun gear member
142B sun gear member
144A ring gear member
144B ring gear member
146 carrier
147A pinion gears
147B pinion gears
154 rotatable gear
156 meshing gear
158 meshing gear
174 air inlet
176 air inlet
178 air outlet
180 air outlet
212 supercharger
214 throttle
222 first set of rotors
224 second set of rotors
234 valve
235 passage
236 valve
236A closed position of valve 236
237 valve
237A closed position of valve 237
256 meshing gear
258 meshing gear
274 air inlet
275 air inlet
276 air inlet
278 air outlet
280 air outlet While the best modes for carrying out the many aspects of the present teachings have been described in detail, those familiar with the art to which these teachings relate will recognize various alternative aspects for practicing the present teachings that are within the scope of the appended claims.

What is claimed is:

1. An assembly for controlling air flow to an engine having cylinders, and a throttle in a throttle body positioned in air flow to the cylinders, the assembly comprising:

a supercharger having a first and a second set of rotors arranged in the air flow to the cylinders in series with the throttle and in parallel with one another;

a gear arrangement operatively connectable to the supercharger;

a load device operatively connectable to the supercharger by the gear arrangement;

controllable valves including a first valve operable to control air flow between an air inlet and an air outlet of the first set of rotors and a second valve operable to control air flow from the outlet of the first set of rotors to the throttle; and a controller;

wherein the first valve, the second valve and the throttle are selectively controlled via the controller to allow both sets of rotors to supply boost pressure to the cylinders under a first predetermined engine operating condition and to allow only the second set of rotors to transfer torque due to a pressure differential across the second set of rotors through the gear arrangement to the load device under a second predetermined engine operating condition to thereby recapture throttling losses.

2. The assembly of claim 1, wherein the load device is an electric motor/generator alternately operable as a motor to apply torque through the gear arrangement to the sets of rotors and as a generator to convert torque applied to the second set of rotors to electric energy.

3. The assembly of claim 1, wherein the engine has a crankshaft, and wherein the gear arrangement has a first member operatively connected with the load device a second member operatively connected with the crankshaft, and a third member connectable for rotation with the supercharger.

4. The assembly of claim 3, wherein the first member is a ring gear member, the second member is a carrier member, and the third member is a sun gear member.

5. The assembly of claim 3, further comprising a clutch controllable to move between a first position and a second position, wherein the clutch is operable to ground the third member with a stationary member when in the first position and to connect the third member to rotate with the second set of rotors when in the second position.

6. The assembly of claim 5, wherein the load device is operable as a motor when the clutch is in the first position to provide torque through the gear arrangement to the crankshaft to start the engine.

7. The assembly of claim 5, further comprising a battery operatively connected to the load device;

wherein the load device is operable as a generator when the clutch is in the first position to convert torque provided from the crankshaft through the gear arrangement to electrical energy stored in the battery.

8. The assembly of claim 7, wherein an additional controller is operatively connected to the battery and to the load device; and wherein the additional controller is operable to control operation of the load device as a motor and as a generator to maintain a relatively constant state-of-charge of the battery.

9. The assembly of claim 3, further comprising a clutch controllable to hold the first member and the load device stationary so that torque from the crankshaft is provided through the gear arrangement to the supercharger.

10. The assembly of claim 1, wherein the controllable valves include the first valve that is selectively movable from a closed position in which the air inlet of the first set of rotors is prevented from fluid communication with the air outlet of the first set of rotors, to an open position in which the air inlet of the first set of rotors is in fluid communication with the air outlet of the first set of rotors to thereby prevent any pressure differential across the first set of rotors; and wherein the controllable valves include the second valve that is selectively movable from a first position in which the air outlet of the first set of rotors is prevented from fluid communication with the throttle body, to a second position in which the air outlet of the first set of rotors is in fluid communication with the throttle body.

11. The assembly of claim 10, wherein the first valve is in the closed position and the second valve is in the open position to allow both sets of rotors to supply boost pressure to the cylinders under the first predetermined engine operating condition; and wherein the first valve is in the open position, the second valve is in the closed position, and the throttle is in a relatively open position so that the second set of rotors applies torque through the gear arrangement to the load device under the second predetermined engine operating condition to thereby recapture throttling losses.

12. The assembly of claim 1, further comprising a clutch selectively engageable to connect a first rotor of the first set of rotors for rotation at the same speed as a first rotor of the second set of rotors, and wherein the clutch is disengaged during the second predetermined engine operating condition.

13. The assembly of claim 1, further comprising a set of intermeshing gears including a first gear connected for rotation with the first rotor of the second set of rotors and a second gear meshing with the first gear and connected for rotation with the second rotor of the second set of rotors.

14. An assembly for controlling air flow to an engine having a crankshaft, cylinders, and a throttle in a throttle body positioned in air flow to the cylinders, the assembly comprising:

an air intake manifold defining a plenum downstream of the throttle body;

a supercharger in series with the throttle in air flow to the cylinders, wherein the supercharger has a first set of rotors and a second set of rotors in parallel with the first set of rotors in the air flow to the cylinders, wherein the supercharger is configured with a separate air inlet and a separate air outlet for each of the sets of rotors;

a load device;

a gear arrangement having a first member operatively connected with the load device, a second member operatively connected with the crankshaft, and a third member selectively connectable for rotation with the second set of rotors;

a clutch operable to selectively engage the third member with a stationary member when in a first position to ground the third member to the stationary member, and operable to selectively engage the third member with the second set of rotors when in a second position; and controllable valves including a first valve operable to control air flow between an air inlet and an air outlet of the first sets of rotors and a second valve operable to control air flow from the outlet of the first set of rotors to the throttle; and a controller;

wherein the first valve, the second valve and the throttle are selectively controlled via the controller to allow both sets of rotors to supply boost pressure to the cylinders under a first predetermined engine operating condition and to allow only the second set of rotors to apply torque through the gear arrangement to the load device under a second predetermined engine operating condition so that torque due to a pressure drop across the supercharger is provided from the supercharger to the load device through the gear arrangement when the two-position clutch is in the second position.

15. The assembly of claim 14, further comprising:

the first valve in a bypass passage connecting the air outlet of the first set of rotors with the air inlet of the first set of rotors, wherein the first valve is selectively movable from closed position in which the air inlet of the first set of rotors is prevented from fluid communication with the air outlet of the first set of rotors through the bypass passage, to an open position in which the air inlet of the first set of rotors is in fluid communication with the air outlet of the first set of rotors through the bypass passage to thereby prevent a pressure differential across the first set of rotors; and the second valve selectively movable from a first position in which the air outlet of the first set of rotors is prevented from fluid communication with the throttle, to a second position in which the air outlet of the first set of rotors in fluid communication with the throttle;

wherein the air outlet of the second set of rotors is in continuous fluid communication with the throttle regardless of positions of the first and the second valves; and wherein the clutch, the load device, and the first valve, the second valve, and the throttle are controllable to establish:

a boost mode in which both the first and the second sets of rotors are operable to boost air flow to the engine;

a bypass mode in which neither of the sets of rotors is operable to boost air flow to the engine or enable capture of throttling losses in the load device; and a regeneration mode in which only the second set of rotors is operable to affect capture of throttling losses in the load device and neither of the sets of rotors is operable to boost air flow to the engine.

16. An assembly for controlling air flow to an engine having cylinders, and a throttle in a throttle body positioned in air flow to the cylinders, the assembly comprising:

a supercharger having a first and a second set of rotors arranged in the air flow to the cylinders in series with the throttle and in parallel with one another;

a gear arrangement operatively connectable to the supercharger; an electric motor/generator operatively connectable to the supercharger by the gear arrangement, the electric motor/generator alternately operable as a motor to apply torque through the gear arrangement to the sets of rotors and as a generator to convert torque applied to the second set of rotors to electric energy a battery operatively connected to the motor/generator;

a first controller operatively connected to the battery and to the motor/generator;

controllable valves including a first valve operable to control air flow between an air inlet and an air outlet of the first set of rotors and a second valve operable to control air flow from the outlet of the first set of rotors to the throttle; and a second controller;

wherein the first valve, the second valve and the throttle are selectively controlled via the second controller to allow both sets of rotors to supply boost pressure to the cylinders under a first predetermined engine operating condition and to allow only the second set of rotors to transfer torque due to a pressure differential across the second set of rotors through the gear arrangement to the electric motor/generator under a second predetermined engine operating condition to thereby recapture throttling losses;

wherein the motor/generator is operable as a generator when a clutch is in the first position to convert torque provided from the crankshaft through the gear arrangement to electrical energy stored in the battery; and wherein the first controller is operable to control operation of the motor/generator as a motor and as a generator to maintain a relatively constant state-of-charge of the battery.

17. The assembly of claim 16, wherein the controllable valves include the first valve that is selectively movable from a closed position in which the air inlet of the first set of rotors is prevented from fluid communication with the air outlet of the first set of rotors, to an open position in which the air inlet of the first set of rotors is in fluid communication with the air outlet of the first set of rotors to thereby prevent any pressure differential across the first set of rotors; and wherein the controllable valves include the second valve that is selectively movable from a first position in which the air outlet of the first set of rotors is prevented from fluid communication with the throttle body, to a second position in which the air outlet of the first set of rotors is in fluid communication with the throttle body.

18. The assembly of claim 17, wherein the first valve is in the closed position and the second valve is in the open position to allow both sets of rotors to supply boost pressure to the cylinders under the first predetermined engine operating condition; and wherein the first valve is in the open position, the second valve is in the closed position, and the throttle is in a relatively open position so that the second set of rotors applies torque through the gear arrangement to the electric motor/generator under the second predetermined engine operating condition to thereby recapture throttling losses.

19. The assembly of claim 16, further comprising the clutch selectively engageable to connect a first rotor of the first set of rotors for rotation at the same speed as a first rotor of the second set of rotors, and wherein the clutch is disengaged during the second predetermined engine operating condition.

20. The assembly of claim 16, further comprising a set of intermeshing gears including a first gear connected for rotation with the first rotor of the second set of rotors and a second gear meshing with the first gear and connected for rotation with the second rotor of the second set of rotors.

* * * * *